US006397916B1

(12) United States Patent
Bengtsson et al.

(10) Patent No.: US 6,397,916 B1
(45) Date of Patent: Jun. 4, 2002

(54) DOOR AS WELL AS METHOD FOR ASSEMBLING A DOOR

(75) Inventors: Mikael Bengtsson, Eldsberga; Håkan Larsson, Halmstad; Pär Fridolfsson, Genevad; Nils Strandh, Gullbrandstorp; Kent Pålsson, Åled, all of (SE)

(73) Assignee: Nomafa AB, Halmstad (SE)

( * ) Notice: Subject to any disclaimer, the term of this patent is extended or adjusted under 35 U.S.C. 154(b) by 0 days.

(21) Appl. No.: 09/600,949

(22) PCT Filed: Feb. 4, 1998

(86) PCT No.: PCT/SE99/00143

§ 371 (c)(1),
(2), (4) Date: Oct. 18, 2000

(87) PCT Pub. No.: WO99/40287

PCT Pub. Date: Aug. 12, 1999

(30) Foreign Application Priority Data

Feb. 6, 1998 (SE) ..... 9800368

(51) Int. Cl.[7] ..... E06B 3/48
(52) U.S. Cl. ..... 160/84.06; 160/183
(58) Field of Search ..... 160/84.01, 84.06, 160/183, 264, 207, 193

(56) References Cited

U.S. PATENT DOCUMENTS

| | | | | |
|---|---|---|---|---|
| 2,812,528 | A | * | 11/1957 | Odell |
| 3,177,926 | A | * | 4/1965 | Brancato et al. |
| 3,857,433 | A | | 12/1974 | Gatzi |
| 4,397,347 | A | * | 8/1983 | Brabant |
| 4,938,273 | A | * | 7/1990 | Dubbelman et al. |
| 5,379,823 | A | * | 1/1995 | Kraeutler |
| 5,394,926 | A | * | 3/1995 | Kraeutler |
| 5,862,850 | A | * | 1/1999 | Yang |
| 6,148,895 | A | * | 11/2000 | Biggers |
| 6,152,207 | A | * | 11/2000 | Varley |

FOREIGN PATENT DOCUMENTS

| | | |
|---|---|---|
| EP | 0113634 | 7/1984 |
| EP | 0412857 | 2/1991 |
| FR | 2545871 | 11/1984 |
| FR | 2706941 | 12/1994 |
| FR | 2722531 | 1/1996 |
| SE | 454526 | 5/1988 |

* cited by examiner

*Primary Examiner*—Blair M. Johnson
(74) *Attorney, Agent, or Firm*—Frommer Lawrence & Haug LLP; Ronald R. Santucci

(57) ABSTRACT

The invention relates to a folding door with a door leaf (4) which is movable between a closed position and an open, folded position, in which the door leaf (4) is folded about folding lines between opposite side edges (5) of the door leaf. A plurality of guide members (110–118) are connected to the side edges (5) in a spaced-apart relationship along the same, and two side frames (1) are extended adjacent to a respective side edge (5). Each side frame (1) defines at least a first and a second guide groove (68, 69), which are juxtaposed transversely of the side frame. The guide members comprise, at each side frame (1), a first set of guide members running in the first guide groove (68) only, as well as a second set of guide members running in the second guide groove only (69). The first and second guide members are connected to the door leaf (4) in such a way that the side edges (5), in the folded position of the door leaf, run back and forth between the first and the second guide groove (68, 69) with the folding lines defined by the guide members. The invention also relates to a method for assembling such a door.

20 Claims, 9 Drawing Sheets

DOOR AS WELL AS METHOD FOR ASSEMBLING A DOOR

FIELD OF THE INVENTION

The present invention relates to the field of folding doors with flexible door leaves. More specifically, the invention relates to a door comprising a door leaf which is at least partly made of a flexible cloth material and which is movable between a closed position and an open, folded position, in which the door leaf is folded around a plurality of folding lines extended between opposite side edges of the door leaf, a plurality of guide members which are connected to the opposite side edges in a spaced-apart relationship along the same, and two side frames which extend adjacent to a respective side edge for guiding the guide members. Such a door is known from e.g. EP 0 113 634. The invention also relates to a method for assembling such a door.

BACKGROUND OF THE INVENTION

Since the 1970s there has been a great need to use rapidly moving doors in buildings for industrial use. This applies to openings indoors as well as in external walls, where the door provides shielding between different activities or prevents draughts/heat losses. Presently, rolling doors with flexible door leaves are used for this purpose, which doors are rolled up on an overhead drive shaft and which can be provided with transverse wind reinforcements on the door leaf to counteract wind load. For security reasons, rolling doors can be provided with a safety edge protection, a drop protection, etc.

Alongside the development of rolling doors, there has been a development in foldable doors according to the introductory paragraph, in which the door leaf is instead folded as it is lifted during the opening process. These door leaves, too, are often provided with transverse wind reinforcements, comprising beams or sections which are suitably connected to the flexible door leaf. The wind reinforcements also contribute to the lateral stability of the door leaf.

The lifting arrangements of known folding doors vary from case to case, but usually the door leaf is lifted with the aid of at least one pair of belts/wires in the lowermost section, so that the transverse sections are gradually gathered in a bundle when the door is opened.

EP 0 113 634 describes a folding door with transverse reinforcement sections. Every other section, beginning with the lowermost one, is extended into the side frames and supports guide rollers which are guided by the side frames in the depth direction, i.e. perpendicular to the door opening. The intermediate sections are shorter and have no guide rollers. Three lifting belts, which run vertically along the door leaf, are each connected to the bottom section. When the belts are rolled up on a transverse overhead shaft, they pull the bottom section upwards, which in turn successively pulls the other sections upwards so that the door leaf is folded in horizontal folds. Since every other section lacks guide rollers and consequently is not guided by the side frames, in the open position these non-guided sections will hang like a cradle by the intermediary of two superjacent guided sections, so that the door leaf is folded like a concertina. By virtue of the fact that the belts run on the exterior of the door leaf and on one and the same side thereof, all the non-guided sections are forced to fall out on the opposite side of the door leaf during the opening motion. Thus, in this known door, the lifting belts ensure that the non-guided sections fall out in one and the same direction.

FR-A1-2,706,941 describes a folding door which, in conformity with the door in EP 0 113 634, has transverse reinforcement sections of which only every other section is guided by the side frames, and where the intermediate sections are non-guided in order to fall out sideways when the door is being closed. However, edge guide members are lacking, and the two side edges of the door leaf hang essentially completely unguided in the depth direction, received in the side frames. In this door, too, the lifting belts are used to ensure that the non-guided sections fall out on one and the same side of the door leaf. The lifting belts are located adjacent to the side frames.

FR-A1-2,722,531 describes a door in which all the transverse reinforcement sections run in one and the same relatively wide guide track in the side frames and where the lifting belts are attached to the second lowest section and run through special belt loops in every other section. These loops result in the sections with loops gathering in a first bundle during lifting, while the sections without loops gather in a second bundle, hanging from the first bundle. The loops ensure that the sections without loops fall out on one and the same side of the door leaf in connection with lifting. Extra safety belts begin operating if the regular belts should break. All belts are located in the door opening between the side frames.

SE 454,526 describes a technique for achieving forced folding of a door leaf, which is divided into horizontal, mutually foldable sections. In an embodiment shown in that document, the door leaf is designed in the form of a unitary, flexible piece of cloth, where every other section beginning with the lowermost is stiffened at its vertical side edges by means of rigid side borders. Every such rigid side border is provided with an upper and a lower guide pulley, which guide pulleys have a constant vertical relative position. These two pulleys run in an associated vertical guide track formed in the stationary side frame of the door. The guide track opening facing the door opening is provided with flanged edges for retaining the guide pulleys in the guide tracks. Thus, there is a plurality of guide tracks in each side frame. The number of guide tracks in each frame equals the number of sections provided with rigid side edges. Thus, only two guide pulleys run in each guide track, and, as a result of the stiffening, the stiffened sections are always vertically orientated in line with their associated guide track, and no folding takes place of these sections in connection with lifting. More specifically, the stiffened sections function as essentially completely rigid sections. In one example, the door leaf has three stiffened and three non-stiffened door leaf sections; and consequently three parallel guide tracks in each side frame.

In SE 454,526 mentioned above, two wires or the like are fastened to the lowermost, stiffened section for lifting and folding the door leaf. During lifting, the non-stiffened sections will be folded in between the stiffened sections, which assume a position beside each other like books on a shelf. When the door leaf has been lifted completely, a concertina-like bundle is obtained where the vertical, stiffened sections stand next to each other in a respective guide track and each intermediate, flexible section is extended obliquely downwards from the top of a stiffened section to the bottom of an adjacent stiffened section. In the lifted position, the whole bundle hangs from the section to which the wires are fastened.

Known folding doors of the type mentioned above exhibit various drawbacks depending upon the design chosen.

In the cases where the lifting belts and any associated loops are placed on the door leaf itself, there is a risk that individuals and vehicles will get caught in and lifted with the door leaf during opening. Moreover, such a placement is not aesthetically pleasing. Making holes for the lifting loops results in indication of fracture/weakening of the door leaf and additional manufacturing costs. In addition, centrally located lifting belts require a horizontal drive shaft or the like above the door.

Another drawback of the prior art doors is that the folding of the door leaf is effected in a non-reliable manner, or in a manner resulting in undesired wear of the door leaf. For example, the door leaf can be folded either inwards or outwards depending on the current pressure difference. This may, for example, result in the door leaf wearing against the upper edge of the door opening and/or the belts.

Any pressure differences are absorbed by the transverse reinforcement sections, which, consequently, are squeezed against the side frames. In that way, in some known doors, the side edges of the door leaf are squeezed between the sections and the frames, resulting in the door leaf wearing out.

Most known folding doors of the type described by way of introduction have a relatively wide side frame in the depth direction (i.e. transversely of the door opening) for receiving the side edge of the door leaf. Such a wide side frame is required to prevent the door leaf from jamming in the side frame during opening and closing. One drawback of having a wide side frame is that the door leaf can move in the depth direction in an undesired manner in connection with pressure differences, resulting in an undesired ability to move in the depth direction in the closed position, a poor aesthetic impression, and incomplete sealing. Moreover, a wide frame requires a large installation area and is expensive and heavy to make and assemble. A particular drawback of the door according to SE 454 526, wherein each stiffened section runs in its own guide track, is precisely that the side edges become very wide and costly as the height of the door and the number of sections increase, since a separate guide track is required for every other section of the door leaf.

These and other drawbacks of the prior art will appear clearly below in connection with the description of the invention.

SUMMARY OF THE INVENTION

In order to reduce the above-mentioned drawbacks of the prior art, according to the invention a door is provided of the type stated by way of introduction, i.e. a door comprising a door leaf which is at least partly made of a flexible cloth material and which is movable between a closed position and an open, folded position, in which open position the door leaf is folded about a plurality of folding lines extended between opposite side edges of the door leaf, a plurality of guide members which are connected to the opposite side edges in a spaced-apart relationship along the same; and two side frames which are extended adjacent to a respective side edge for guiding the guide members. The door according to the invention is characterised in that each side frame defines at least a first and a second guide groove, that said guide members comprise, at each side frame, a first set of guide members running in the first groove only of the side frame, and a second set of guide members running in the second groove only of the side frame, and that the first and the second guide members are connected to the door leaf in such a way that the side edges, in the folded position of the door leaf, run back and forth between the first and the second guide groove with said folding lines defined by the guide members.

A "flexible cloth material" could be any suitable kind of cloth, fabric or sheet of a flexible, foldable material, which can be coated or uncoated.

When the door according to the invention is being opened or closed, the first guide members run in the first groove only and the second guide members run in the second groove only. In each groove, the associated guide members will be successively brought together during the opening motion. As a result, the mutual distance between the first guide members as well as the mutual distance between the second guide members will decrease when the door opens. Although, at present, it is probably preferable to have two guide grooves only in each side frame, it is within the scope of the invention to add one or more supplementary guide tracks, but in such variants it is still the case that the guide members in the first and the second guide groove are mutually brought together during the opening motion.

The expression "guide groove" can refer to a physical channel or the like, but it can also be interpreted as an abstract term and shall be considered to include all variants where the side edges are provided with special guide devices or means for defining two separate, predetermined movement paths or tracks for the guide members. Usually, the two guide grooves, which are defined by the side frames, are juxtaposed transversely of the door opening, but it is also possible that this distribution in the side frame itself is in a direction parallel to the door opening. In the latter case, there must be special connection members between the guide members and the edges of the door leaf, so that the attachment points in the edges of the door leaf run along two parallel lines or paths spaced from each other transversely of the door opening. In one embodiment, the first and the second guide groove can, for example, each be formed as a physical channel, whose side walls achieve the guiding of the guide members. These channels can be open towards the door opening but, with suitable connection members between the guide members and the door leaf edges, it is possible to turn the openings of the channels away from each other, so that one opening faces the front of the door and the other opening faces the rear of the door. As an alternative to physical channels, each guide groove can instead be defined by a rod or the like fixedly arranged in the side frame with which the guide members engage slidably in a suitable manner.

Usually, the door according to the invention would be orientated with vertical side frames and a vertically guided door leaf. However, it is within the scope of the invention to place the door horizontally instead, but to facilitate the description and definition of the invention, terms such as "lifting", "vertical side frames", etc. are used throughout this specification. Accordingly, if the door is to be placed lying down, these orientation-determining expressions should be interpreted to include the horizontal case as well.

It should be noted that the above-mentioned "plurality of guide members" can comprise "further guide members" in addition to said first guide members and said second guide members, for example special guide members at the closing edge of the door leaf. Even if the first and the second guide members are normally located alternatingly in the first and the second guide groove, there may be portions of the door leaf where two adjacent guide members are located in the same guide groove.

Several advantages are achieved by the invention by the provision of the double guide tracks in the side frames, as well as by the distribution of the guide members in the same:

1. A first advantage of double guide tracks is that the folding of the door leaf becomes much more exact and controlled in comparison with how the folding takes place in the known doors. A controlled folding in the side frames in turn leads to generally safer functioning with a reduced risk of a breakdown, and to a considerable improvement in the appearance of the door leaf during operation. Moreover, no special pre-folding members or wear protection is necessary.
2. As mentioned above, the side frames of the prior art doors must often be wide in the depth direction of the door opening in order to prevent the door leaf from jamming during lifting. The door according to the invention does not have that problem. Accordingly, a second advantage of double guide tracks is that the depth of the frame can be reduced considerably. The depth of the frame is mainly determined by the size of the guide elements in the depth direction of the door, but also by the amount of space required for the side edge itself of the door leaf.
3. A third advantage of double guide tracks and of the side frames actively influencing the folding in the direction desired is that all lifting members, such as belts or wires, can be located protected within the side frames. Unlike in known doors, the lifting members need not be mounted on the surface of the door leaf for guiding the folding, but can be located protected in the side frames. This in turn means that both the lifting members and the environment are protected. The general appearance of the door also becomes more attractive with concealed lifting members. The driving can be achieved with two lifting points only, and if a variant with a transverse drive axle is used, it can be made with a less substantial dimension. Placing all the lifting members in the side frames also yields the advantage that no transverse drive shaft is needed above the door since belt drums can be attached directly to the side frames. However, it should be noted that, for example, in connection with very wide and/or heavy doors, it might be necessary to provide supplementary safety belts/lifting belts in the middle to prevent deflection. However, unlike in the prior art, it is not necessary to use such an additional belt for guiding the folding, but only for reducing the stress on any fall-out-preventing means in the side frame.
4. A fourth advantage of double guide tracks is that, in its closed position, the door leaf can be positioned centrally in the depth direction between the guide tracks. This results in improved sealing and appearance, reduces wear and provides a more compact frame. In particular, the side edges of the door leaf can be guided in separate sections in the depth direction for obtaining an exceedingly compact door in the depth direction.

Normally, the transverse folding lines, or extensions thereof, of the door leaf, will intersect the guide grooves. Accordingly, if the door leaf is provided with a plurality of transverse reinforcement members, each of which is extended between an associated pair of guide members, extensions of these reinforcement members can intersect the guide grooves for defining the folding lines of the door leaf. In order to obtain a straighter door leaf in the closed position, all the reinforcement members, or at least the majority of them, can lie alternatingly on the one and on the other side of the door leaf. In a special case, the two lowermost reinforcement members can be located in the same guide groove.

With respect to the space requirement at the upper part of the door, it will be appreciated that, in principle, the space required in the depth direction for the reinforcement members, when these are piled on top of each other according to the invention in two guide grooves, is only half as large as in the prior art where they are piled up in one and the same channel.

In a preferred embodiment of the invention, the first guide groove and the second guide groove in each side frame comprise a first physical guide channel and a second physical guide channel respectively, which are open in the direction of the door opening and have a width in the depth direction which is adapted to the dimensions of the guide members in the same direction. In this connection, the guide members can consist of non-rotatable sliding members or rollers. However, it is essential that no large play is required in the depth direction between the guide members and the side walls of the guide channels.

Each guide channel can be provided with a fall-out-preventing means for retaining the guide members. The guide members can be designed themselves to prevent a fall if a lifting member breaks.

According to a first embodiment, each side frame is provided with a U-section, whose bottom wall partly covers the two guide channels in order to form fall-out-preventing means, extended along the frame and open towards the door opening. In this connection, this U-section can have a double function since the side edge of the door leaf can be inserted in and seal against the U-section. One part of this U-section can be detachable for installation and maintenance. This embodiment yields the advantage that both the guide members and the side edges of the door leaf have a limited ability to move in the depth direction—i.e. they have good guiding in the depth direction and that the door leaf is centred in the depth direction relative to the guide tracks.

According to a second embodiment, each side frame comprises a bottom wall, a first outer side wall and a first partition which both extend from the bottom wall for defining said first guide channel, and a second outer side wall and a second partition which both extend from the bottom wall for defining said second guide channel, wherein said first and second partitions define therebetween a space which receives the side edge of the door leaf. In this embodiment, the partitions serve two purposes: they define the guide channels and they receive therebetween the side edge of the door leaf in order to guide it along the side frame. In this embodiment, said partitions and said outer side walls can be provided with fall-out-preventing flanges adapted to retain the guide members in the guide channels.

The door leaf can be formed optionally as a continuous piece or divided into sections held together with e.g. transverse reinforcement sections. The door leaf can be formed entirely of a flexible cloth material, but the invention will also work if some door leaf sections are rigid. More specifically, the door leaf can be lifted in such a way that every other section is not folded, and these section can be made of a more rigid or a completely rigid material, while the other sections which are folded must be made of a flexible material.

Preferably, there is at least a first flexible pulling member, such as a belt, a wire, a chain or the like, in each side frame for guiding the movement of the door leaf. If the guide grooves are physical channels, the pulling members can suitably be located in the same. In one embodiment, a direct lifting force is applied to only a single guide member in each side frame, called a driven guide member. If the door leaf runs alternatingly between the two guide tracks all the way down to its closing edge, the lifting can be effected in the lowermost guide member. However, in some cases, there may be a special safety arrangement with a bottom section having a reduced weight. In such a case, the lifting be effected in the second lowest guide member instead. If, however, there is only one pulling member in each side frame, these members can consist of a continuous pulling member. Moreover, there can be double pulling members or more in each side frame.

In principle, the lifting force applied to the driven guide members can be transmitted to superjacent guide members in two different ways. Either the design is such that the guide members strike against each other during the lifting, so that the lifting force is transmitted directly in the side frame. Alternatively, transverse reinforcement sections are used which are of such thickness that they will strike against each other before the guide members strike against each other. In this case, the lifting forces are instead transmitted by the intermediary of the reinforcement sections and, specifically, in this connection, guide members in the form of rotatable rollers can be used, which may be problematic if the guide members are to abut against each other.

In one embodiment of the invention there may also be a further pulling member in each side frame which applies a direct lifting force to a second driven guide member, the first and the second driven guide members running in different grooves. If, for example, the second driven guide member is located closer to the closing edge of the door leaf, its pulling member can be driven a somewhat longer distance than the first pulling member for achieving an "extra lift" of the second driven pulling member during the opening motion of the door. This can, for example, be achieved by the use of larger diameters in the winding drums for the second pulling members and/or greater thickness in the latter. Another possibility is to lift the last section more at the end of the lifting motion by virtue of only the lower part of the pulling member having a substantially greater thickness or to mount a member on the lower part of the pulling member which gives it an extra lifting motion at the end of the opening motion. The advantage of such an extra lift is that the vertical dimensions of the door leaf in the open position can be further reduced.

For easy transportation and installation of the door, each side frame can be divided into a shorter top part and a longer bottom part. The top parts are made with such a length that all guide members, which are connected to the side edges of the door leaf, can be received in the top parts simultaneously. In this way, the whole door leaf, all the reinforcement sections, all the lifting members, the upper part of the frames as well as the drive unit can be pre-assembled at the factory and be delivered to the installation site as a single unit. The top parts with the guide members inserted therein are mounted to the bottom parts only at the location where the door is to be installed. In assembling the frame parts, the guide grooves are likewise assembled, and the guide members and the pulling member can then be inserted into the side frames and the door can be used directly.

These and other embodiments and advantages of the invention will appear from the claims and from the following detailed description of preferred embodiments.

DETAILED DESCRIPTION OF THE PREFERRED EMBODIMENTS

Figure 1:
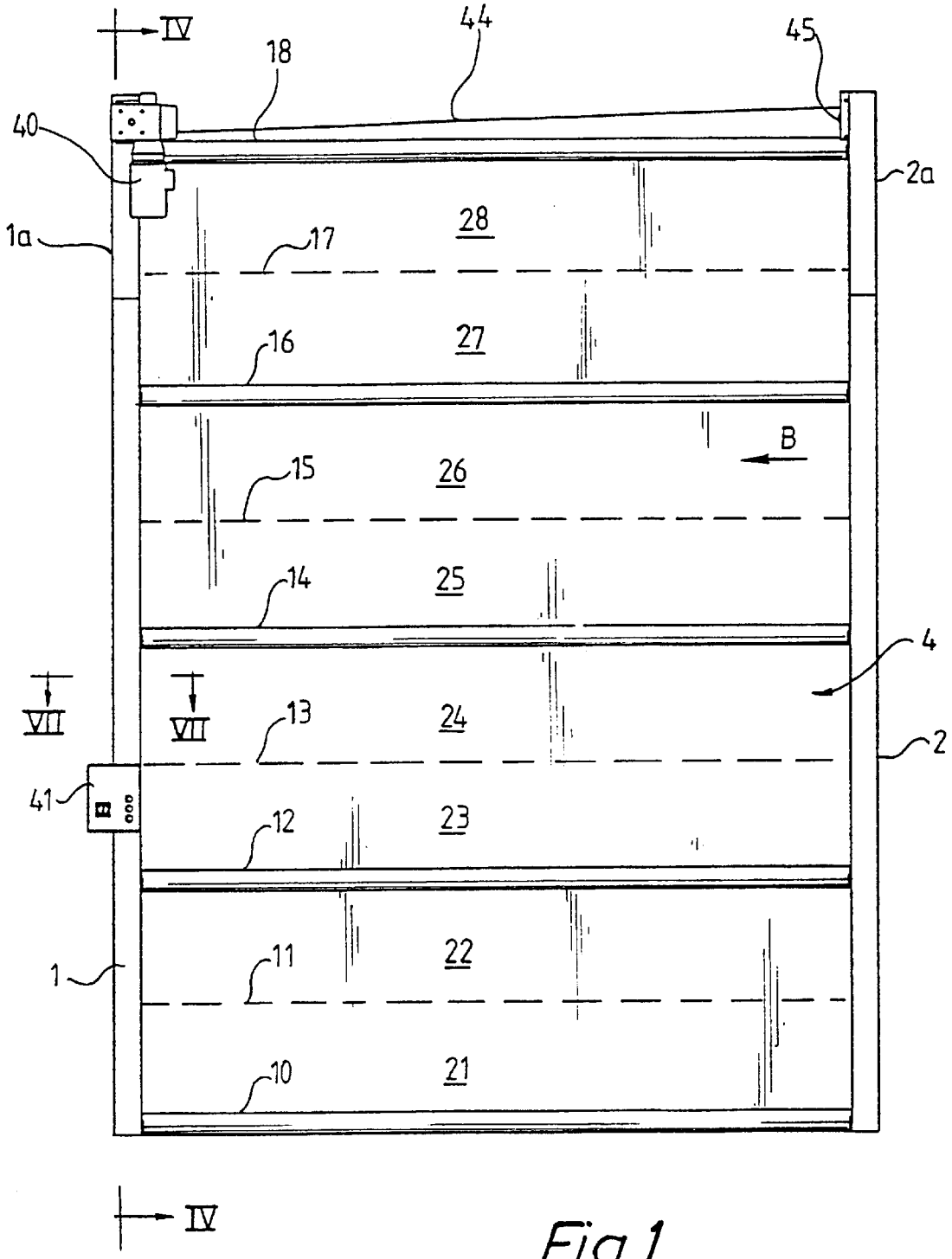
FIG. 1 shows the front of a completely closed door according to a preferred embodiment of the invention.
Figure 2:
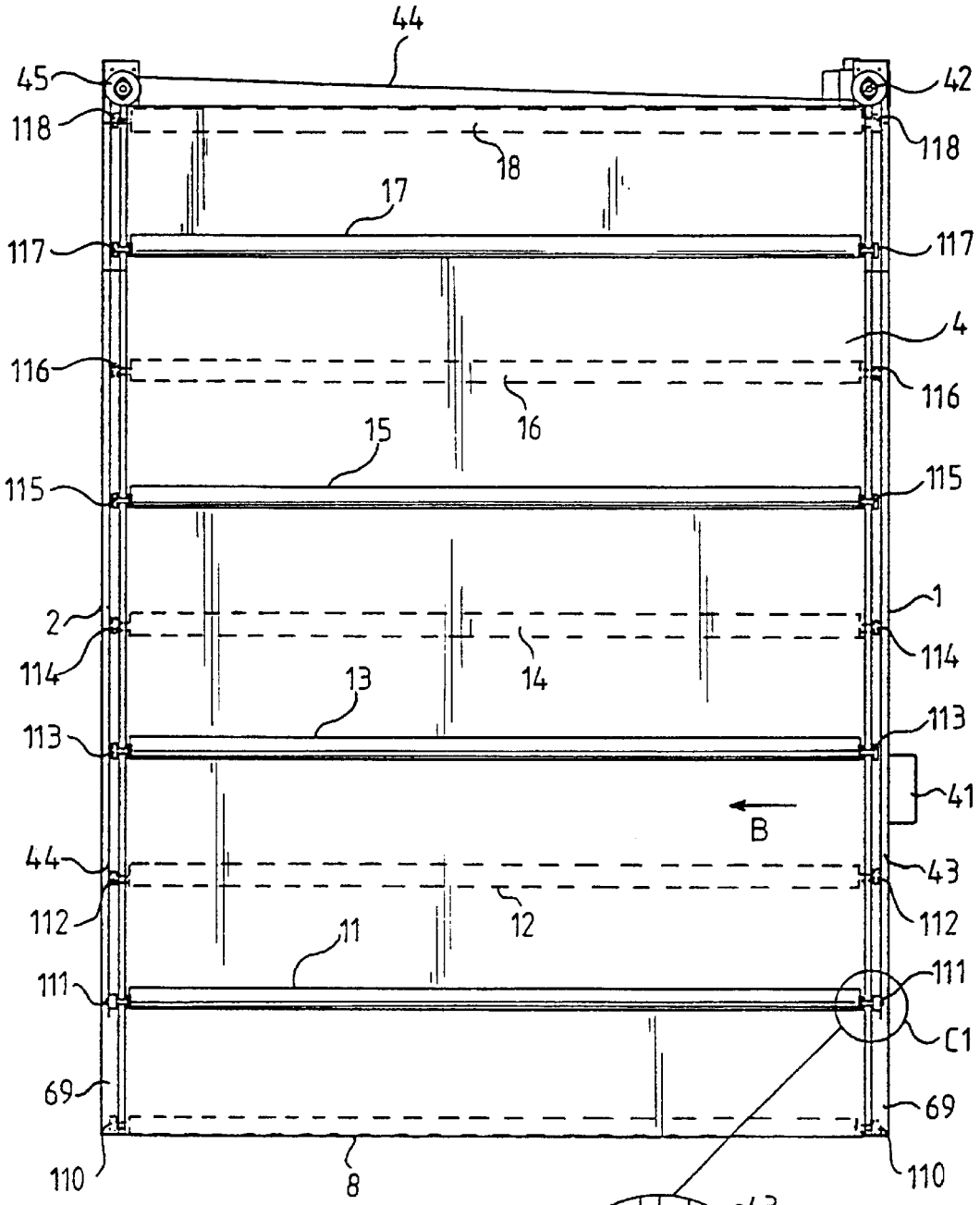
FIG. 2 shows the back of the door in FIG. 1, with the side frames partly broken away for showing guide elements running in the same.
Figure 3:
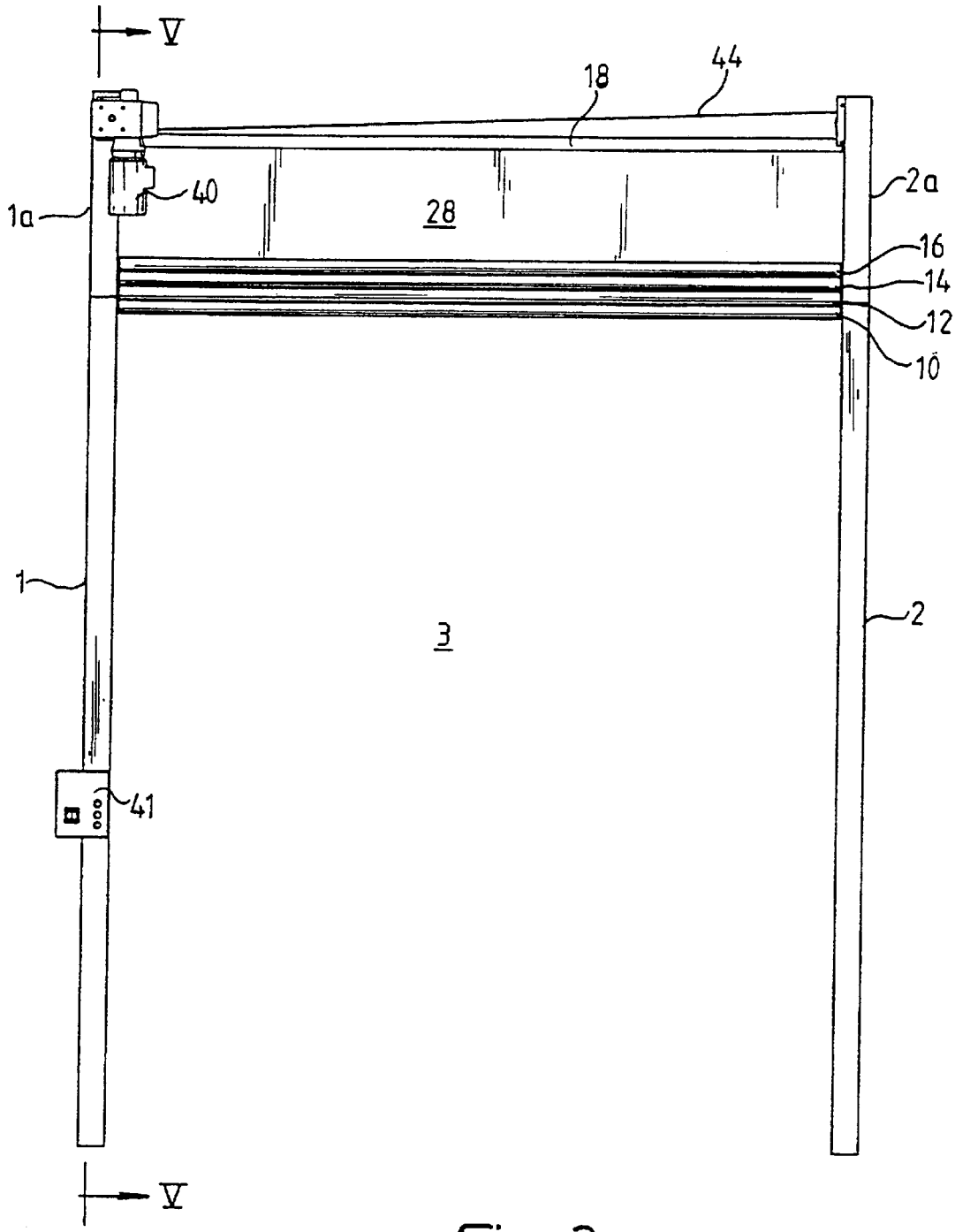
FIG. 3 shows the front of the door in FIG. 1 in its completely open position.
Figure 4:
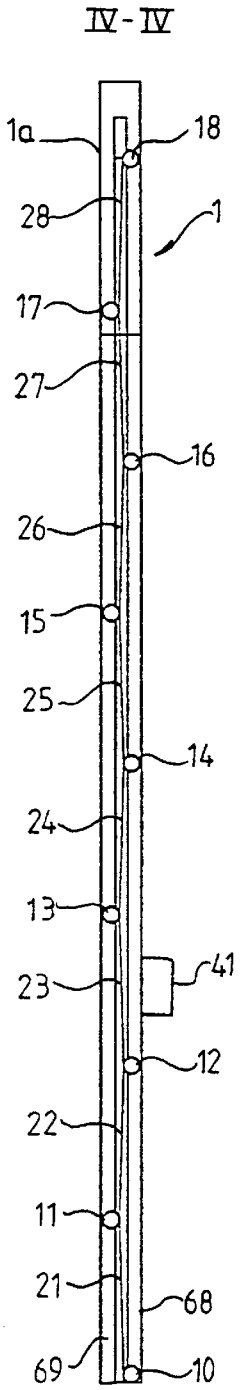
FIG. 4 is a cross-section of the closed door in FIG. 1 taken along the line IV—IV.
Figure 5:
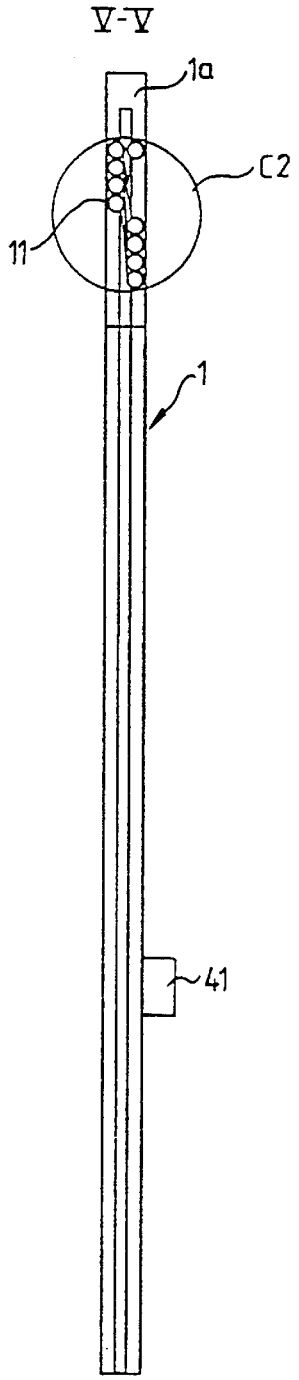
FIG. 5 is a cross-section of the open door in FIG. 3 taken along the line V—V.

FIGS. 1–7 show a door according to a preferred embodiment of the invention. Two vertical side frames 1 and 2 define a door opening 3. A door leaf generally designated 4 is made of a flexible cloth material (continuous or of assembled sections) and is movable between an unfolded closed position (FIGS. 1, 2 and 4) and a concertina-like folded open position (FIGS. 3 and 5).

Figure 6:
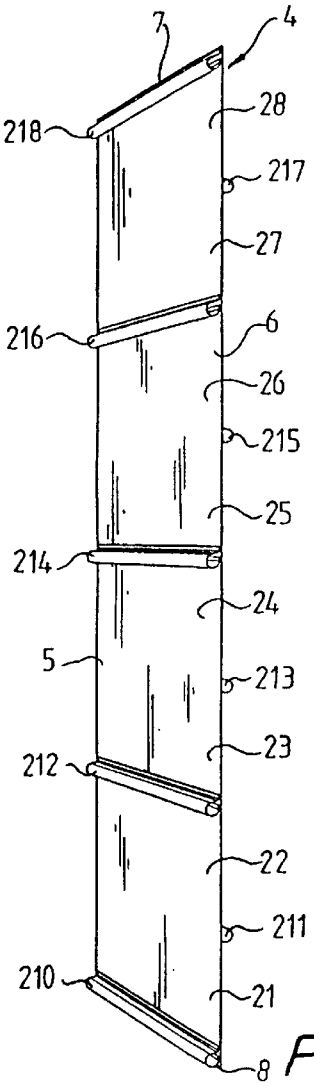
FIG. 6 is a perspective view of a door leaf.
Figure 9:
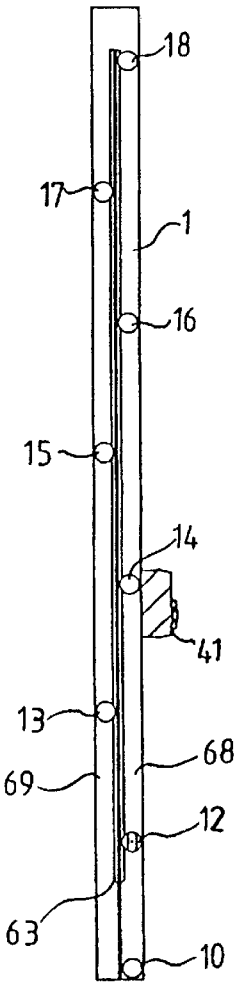
FIG. 9 is a cross-section taken along the line IX—IX in FIG. 8.
Figure 8:
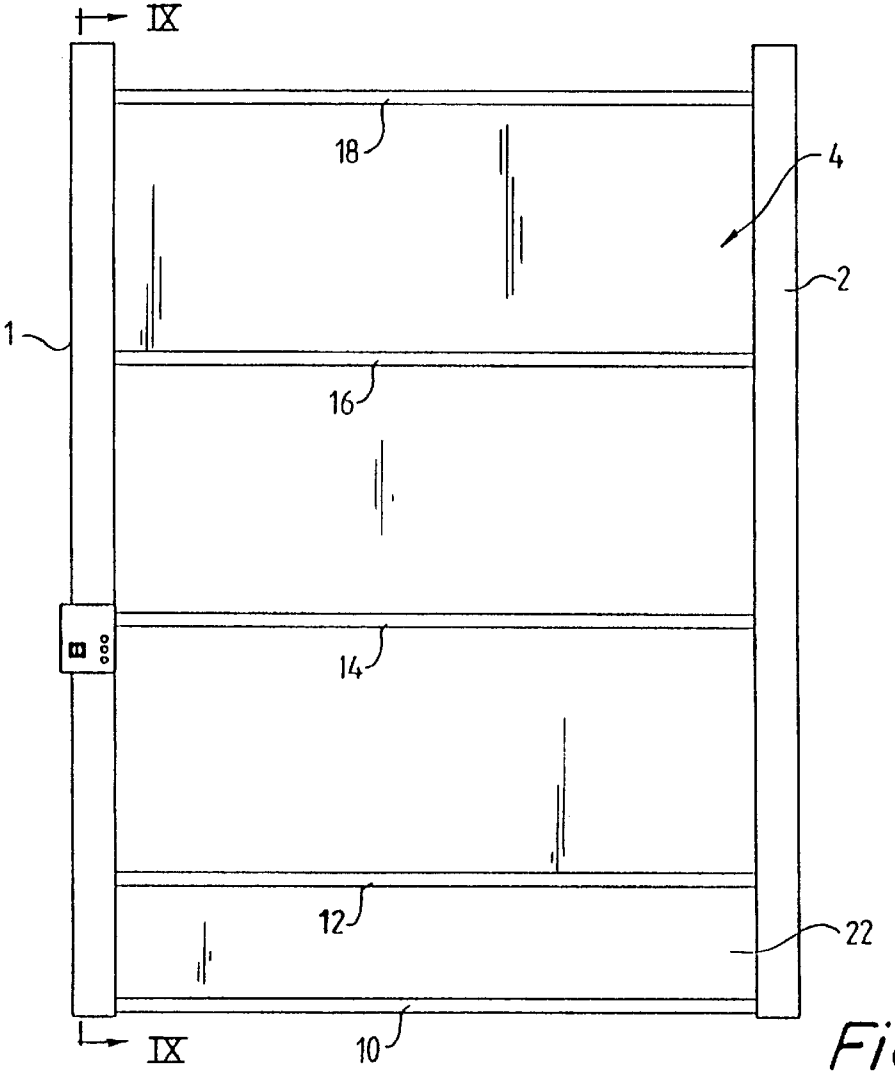
FIG. 8 is a front view of a completely closed door of essentially the same design as in FIGS. 1–7, but with the two lower reinforcement members running in the same guide channel.
Figure 11:
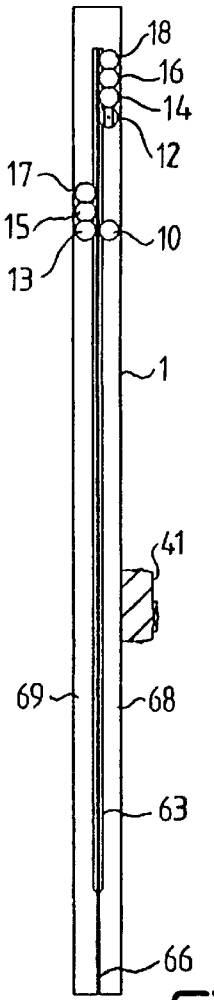
FIG. 11 is a cross-section taken along the line XI—XI in FIG. 10.
Figure 10:
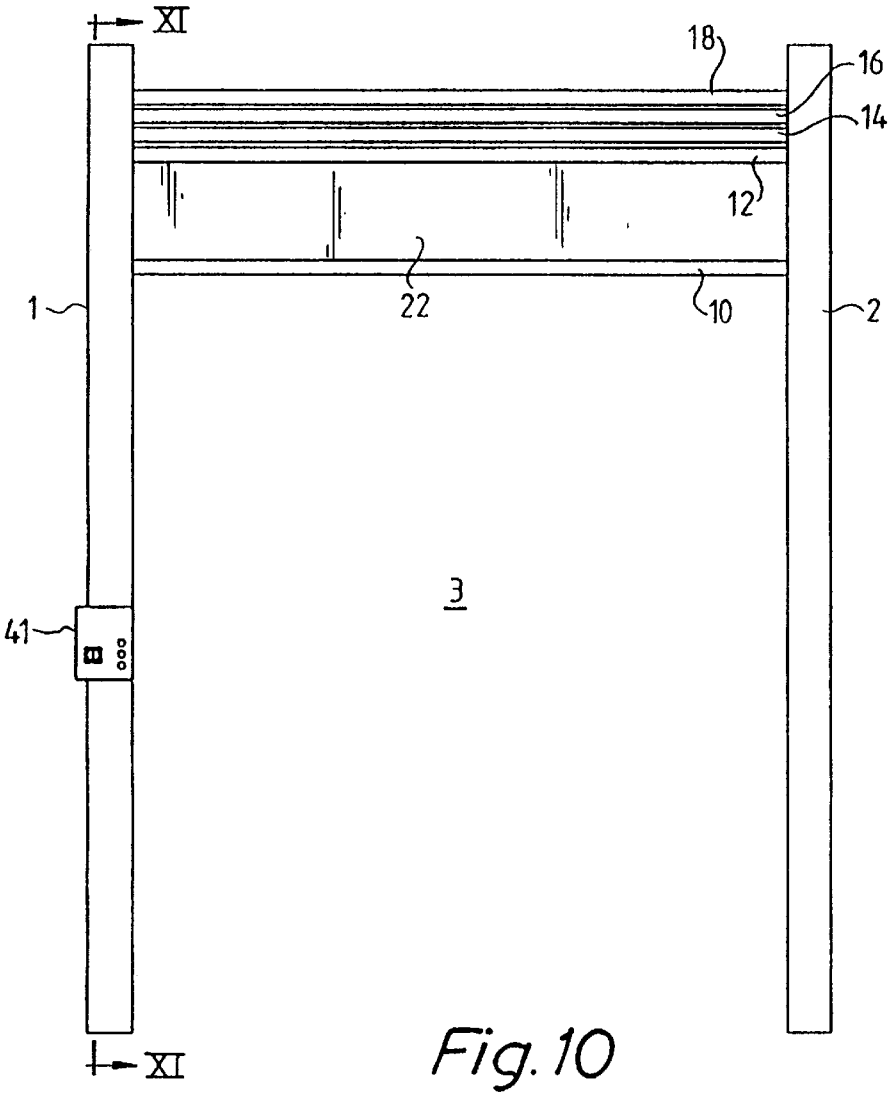
FIG. 10 shows the door in FIG. 8 in its completely open position.

In FIG. 6, the door leaf 4 is detached and completely unfolded. The door leaf 4 has two opposite side edges 5 and 6, a top edge 7, and a bottom or closing edge 8. In this case, the door leaf 4 is made of a cloth-like material, for example a plastic-coated fabric. In order to absorb wind load, the door leaf 4 is provided with a plurality of transverse reinforcement members 10–18, which are extended between the side edges 5 and 6. The length of the reinforcement members 10–18 is essentially equal to the width of the door leaf 4. Five reinforcement members with even reference numerals (10, 12, 14, 16, 18) are mounted on the front of the door leaf 4 (FIG. 1), while four reinforcement members with odd reference numerals (11, 13, 15, 17) are mounted on the back of the door leaf 4 (FIG. 2). In the embodiment shown, the reinforcement members 10–18 are arranged equidistantly but in other embodiments, the distance between them may vary along the height of the door leaf 4. The reinforcement members 10–18 define eight horizontal door leaf sections 21–28.

The reinforcement members 10–18 can be connected to the door leaf 4 in many different ways, and there are several known variants for achieving this. In this case, the cloth material is provided with elongate pockets 210–218 (FIG. 6) for this purpose and, specifically, there is a special pocket 218 at the top edge 7 of the door leaf 4 for attaching the top edge 7 between the side frames 1 and 2 with the aid of the top section 18.

The fact that the reinforcement members 10–18 are mounted alternatingly on the front and on the back yields the advantage that door leaf 4 hangs straighter in the unfolded position compared to if the reinforcement members 10–18 had been mounted on one and the same side of the door leaf 4. A straighter door leaf in the closed position also provides better sealing at the side edges 5, 6. However, there may a certain limited amount of folding in the unfolded position, as shown in FIG. 4, the door leaf 4 assuming a "wave-like" not totally plane shape with straight portions between the guide members.

The top edge 7 of the door leaf 4 can be suitably attached in an upper horizontal part of the building in which the door is installed or, as in this embodiment, the top edge 7 can be attached with the aid of the top pocket 218 on a special, horizontal top member 18 which is fastened to the side edges 1 and 2, and/or to the building.

A drive motor 40 is mounted on an upper corner of the door. The reference numeral 41 indicates an electric/electronic control unit, which is not described in detail, for controlling the drive motor 40. The driving equipment also includes a belt drum 42 driven by the motor 40, which drum winds/unwinds two flexible pulling means 43 and 44 for raising and lowering the door leaf 4. In this embodiment, the pulling means 43 and 44 are in the form of two lifting belts, but they can also be formed as lifting wires or the like. The lifting belt 43 runs directly down from the belt drum 42 in the first side frame 1, while the lifting belt 44 runs over a return roller 45 onwards down in the second frame 2. The attachment of the lifting belts 43 and 44 to the door leaf 4 will be described below. In particular, it should be noted that there are no lifting belts in the door opening 3 between the side frames 1 and 2.

Figure 2A:
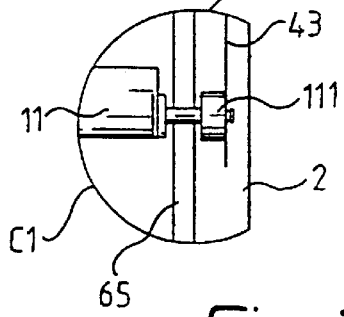
FIG. 2A shows, on an enlarged scale, the area C1 in FIG. 2.
Figure 7:
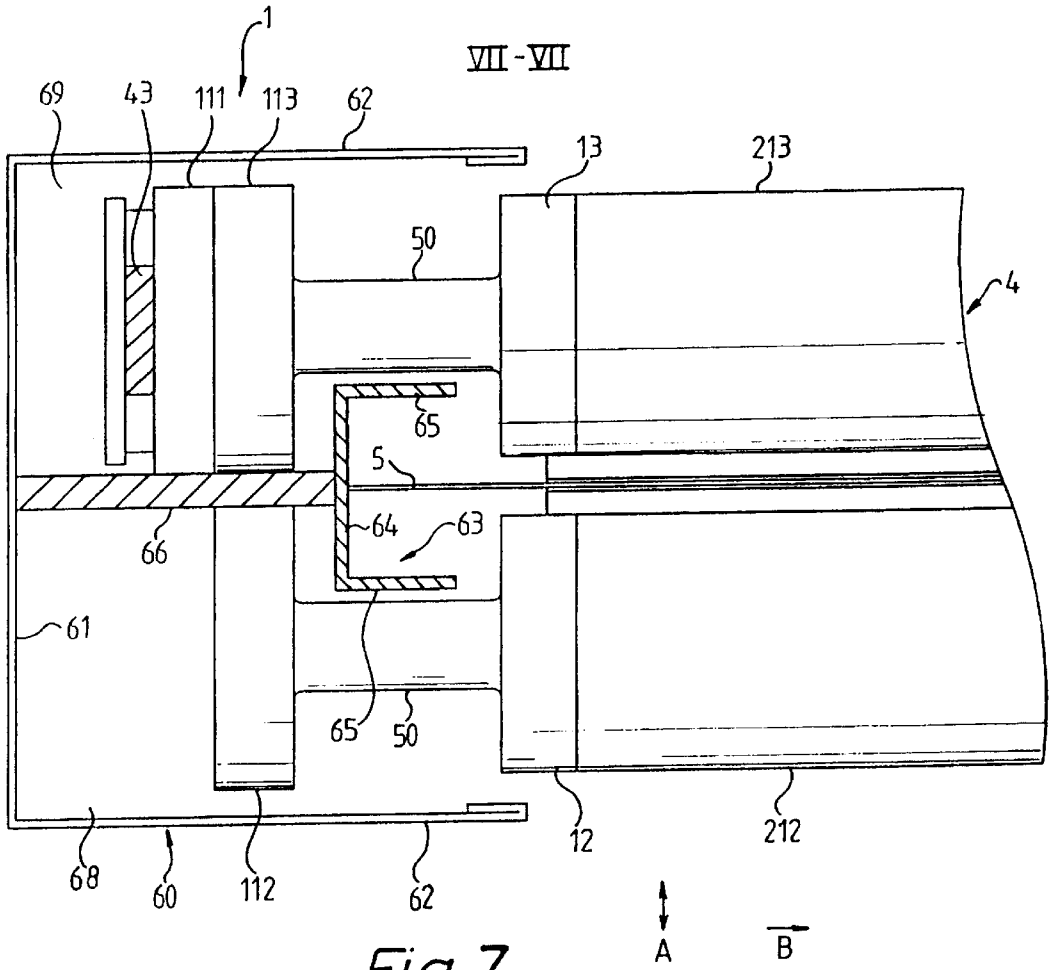
FIG. 7 is a breakaway cross-sectional view taken along the line VII—VII in FIG. 1 and shows the appearance of the guide channels, the guide members and the side sealing.

As can be seen from FIGS. 2, 2*a* and 7, the door leaf 4 is provided with a plurality of separate edge guide members 110–118, which are spaced along the opposite side edges 5 and 6 of the door leaf 4 and which are adapted to move along the side frames 1 and 2. Each end of all the reinforcement members 10–18 are connected to an associated edge guide member by means of a narrower extension 50. To facilitate this description, the same reference numerals are used for the edge guide members as for the associated reinforcement section plus one hundred, i.e. 110–118.

In this embodiment, the guide members 110–118 are composed of non-rotatable, puck-shaped sliding blocks, which serve both as guide members in the depth direction, i.e. transversely of the plane of the door opening (arrow A), and as fall-out-preventing means in the direction parallel to plane of the door opening (arrow B). The guide members 110–118 can also be formed as rotatable rollers, but in that case one must take into consideration that there may be a problem of counter-rotating surfaces if such rotating rollers are caused to contact each other during opening/closing. However, this can be solved if the reinforcement members 10–18 strike against each other before the guide members 110–118 strike against each other.

FIG. 7 shows how one side edge 5 of the door leaf 4 is connected to and guided along the corresponding side frame 1. The arrangement in the other side edge 2 is identical and, therefore, is not described. The side frame 1 is designed to achieve guiding of the folding of the door leaf 4, guiding of its motion in the depth direction (arrow A) and in the transverse direction (arrow B), and sealing of the side edge 5 of the door leaf 4 against the side frame 1. To this end, the side frame 1 is composed of a U-shaped frame section 60 with a bottom wall 61 and two opposite side walls 62. Centrally in the frame section 60 there is a smaller U-shaped inner section 63, having a bottom wall 64 and two opposite side walls 65. In this embodiment, the inner section 63 is located entirely inside the frame section 60 and is fixedly mounted therein by means of a partition 66, which is rigidly connected to the bottom wall 61. The partition 66 extends along essentially the entire length of the frame section 60. The inner section 63 can be broken away for part of the distance, for example at the bottom or the top, but it can also be completely or partly removable for repairs, etc.

Together with the partition 66, the side walls 62 of the frame section 60 define both a first guide groove in the form of a channel 68 open towards the door opening, and an adjacent second guide groove in the form of a channel 69 open towards the door leaf 4. The channel 68 is thus located closest to the front of the door (FIG. 1), while the channel 69 is located closest to the rear of the door (FIG. 2). The front guide members 110, 112, etc. for the front reinforcement sections 10, 12, etc. run in the first channel 68, while the rear guide members 111, 113, etc. for the rear reinforcement sections 11, 13, etc. run in the second channel 69.

The lifting belts 43 and 44 are fixedly connected to the guide members 111, i.e. to the second lowest section 11. To illustrate this, the guide member 111 is specially marked in FIGS. 2 and 2A. FIG. 7 specifically shows that the guide member 111 is thicker to prevent the lifting belt 43 from coming into contact with the other guide members. Thus, the lifting belt 43 runs completely protected inside the guide channel 69.

During raising/lowering, the guide members 110–118 are guided against the partition 66 and/or the side walls 62. Since, in this way, the separate guide members 110–118 run in and are guided in the depth direction A by means of two separate guide grooves 68 and 69, the folding of the door leaf 4 around the reinforcement members 10–18 will with certainty be guided in the correct manner, which, not least, reduces wear on/damage to the door leaf 4. In contrast to the prior art with one common wide channel only for all the guide members, the width of each guide channel 68 and 69 in the depth direction A is adapted to the depth dimension of the guide members, instead of, as in known doors, being adapted to the depth dimension of the folded door leaf 4. It will be appreciated that the gravitational force acting on the door leaf 4 will strive to bring the guide members into contact with the partition 66, but in the case of wind load/pressure difference, the guide members in one guide channel (68 or 69 depending on the direction of the wind) can instead run against one of the side walls 62 of the frame section 60.

In each guide channel 68 and 69, the bottom wall 64 of the inner section 63 forms a flanged edge preventing the guide members 110–118 from falling out from their respective guide channel because of wind load or because a reinforcement section gets stuck in connection with closing. The guide members 110–118 are preferably designed to prevent a major drop if one of the lifting belts 43, 44 should break. To enable e.g. the replacement of reinforcement sections, a part of the inner section 63 can be removable, as mentioned above.

The second function of inner section 63, in addition to forming fall-out-preventing means for the guide members 110–118, is to provide side or edge sealing for the door leaf 4. As appears from FIG. 7, the longitudinal channel of the inner section 63 is open towards the door leaf 4 for receiving the door leaf edge 5. In this embodiment, the side edge abuts sealingly against the bottom wall of the section 63. If the door leaf 4 is subjected to wind load or if there is a difference in pressure, it will move into contact with the side walls 65 of the inner section 63, enabling sealing to occur in this location as well. However, it should especially be noted that the movement of the side edge 5 in the depth direction is limited by the width of the inner section, which is considerably smaller than the width of the frame section. It is possible to make the side walls 65 flexible to allow somewhat greater freedom of motion for the door leaf edge 5 in the depth direction in connection with lifting.

Figure 5A:
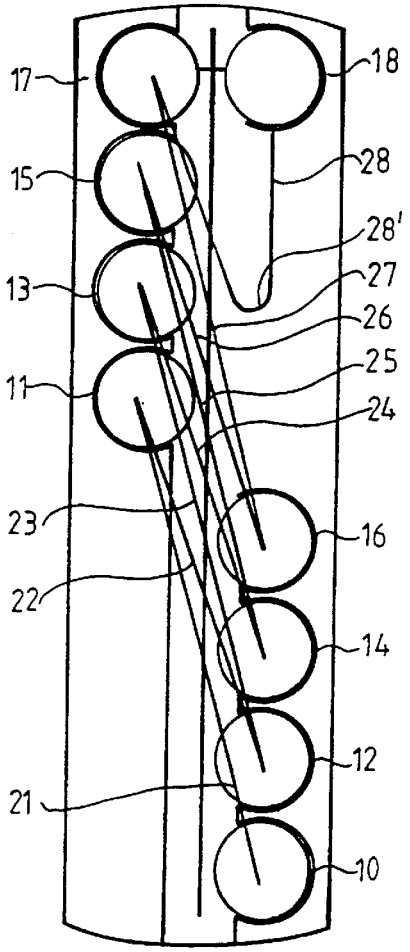
FIG. 5A schematically and on an enlarged scale shows the area C2 in FIG. 5 with, for the sake of clarity, the door leaf sections shown as extending between the centre of the reinforcement members, although, in reality, the cloth material can connect to the outside of the sections.

For or opening the door, the lifting force is thus applied by the intermediary of the guide members 111 to the second lowest section 11. Accordingly, during the entire lifting motion, the lowest bottom section 10 hangs from section 11 by the intermediary of the cloth section 21. In the first phase of the lifting, the cloth section 22 will be folded around a "rolling" fold. When section 11 passes section 12, section 22 begins to straighten out again in order to reach a completely or essentially completely extended state when guide member 111 strikes against guide member 113 superjacent in the same groove 69. Depending on the construction, contact can instead be achieved between sections 11 and 13. In this phase, sections 11 and 13 are thus located adjacent to each other, while section 12 is hanging like a cradle in these two sections 11 and 13 by the intermediary of the now straight sections 22 and 23. In this stage, the bottom section 10 is located in the vicinity of or in contact with section 12, but is still hanging from section 11. In connection with continued lifting, section 24 will first be folded and then begin to straighten out as section 13 passes section 14. This folding process with successive gathering of the guide members/sections continues until the situation shown in FIGS. 3, 5 and 5A is obtained. The guide members 111, 113, 115, and 117 on the back are now completely gathered at the top of the rear guide groove 69, while the guide members at the front in the front groove 68 assume the position shown in FIG. 3. In the completely open position, the uppermost cloth section 28 is bent round a "rolling fold" (reference numeral 28' in FIG. 5A), and a part of the cloth section 27 second from the top is visible from the front. The remaining cloth sections are lying obliquely between the first and the second guide groove 68 and 69, and no cloth sections are hanging out in the depth direction outside the side frames 1 and 2.

In order to reduce the height of the folded door leaf 4 in FIGS. 3 and 5, special lifting means can be arranged for achieving an extra lift of the bottom section 10, so that the sections 10, 12, 13, 14, 16 and 18 can also be bunched together completely. This can, for example, be achieved by means of an extra lifting belt (not shown) in the guide groove 68 for lifting the guide members 110. In this case, this additional lifting belt must be driven in such a way that it moves somewhat farther than the first lifting belt 43. One solution is to use a larger diameter belt drum. Another solution is to make the extra belt thicker at the bottom. A further solution is to arrange some type of slip couplings on the belt drums.

Referring now to the embodiment in FIGS. 8–11, wherein the same parts as in the embodiment in FIGS. 1–7 have the same reference numerals. The embodiment in FIGS. 8–11 is characterised in that the cloth section 21, the section 11, and the guide members 111 have been omitted. The lower-most cloth section 22 of the door leaf 4 runs straight along the front guide channel 68, and lifting is effected in the guide members 112 instead. In the open position, the cloth section 22 hangs from the section 12 by virtue of the weight of the section 10, so that this cloth section 22 conceals the posteriorly situated sections 13, 15, 17. This embodiment is interesting from a safety point of view, since the lower bottom section 10 can be made softer and more flexible to avoid damage in case of an impact. The bottom edge 7 can be provided with suitable safety devices of a design known per se, e.g. an elongated, pressure sensitive safety edge protection, which interrupts the door motion when acted upon.

Figure 12:
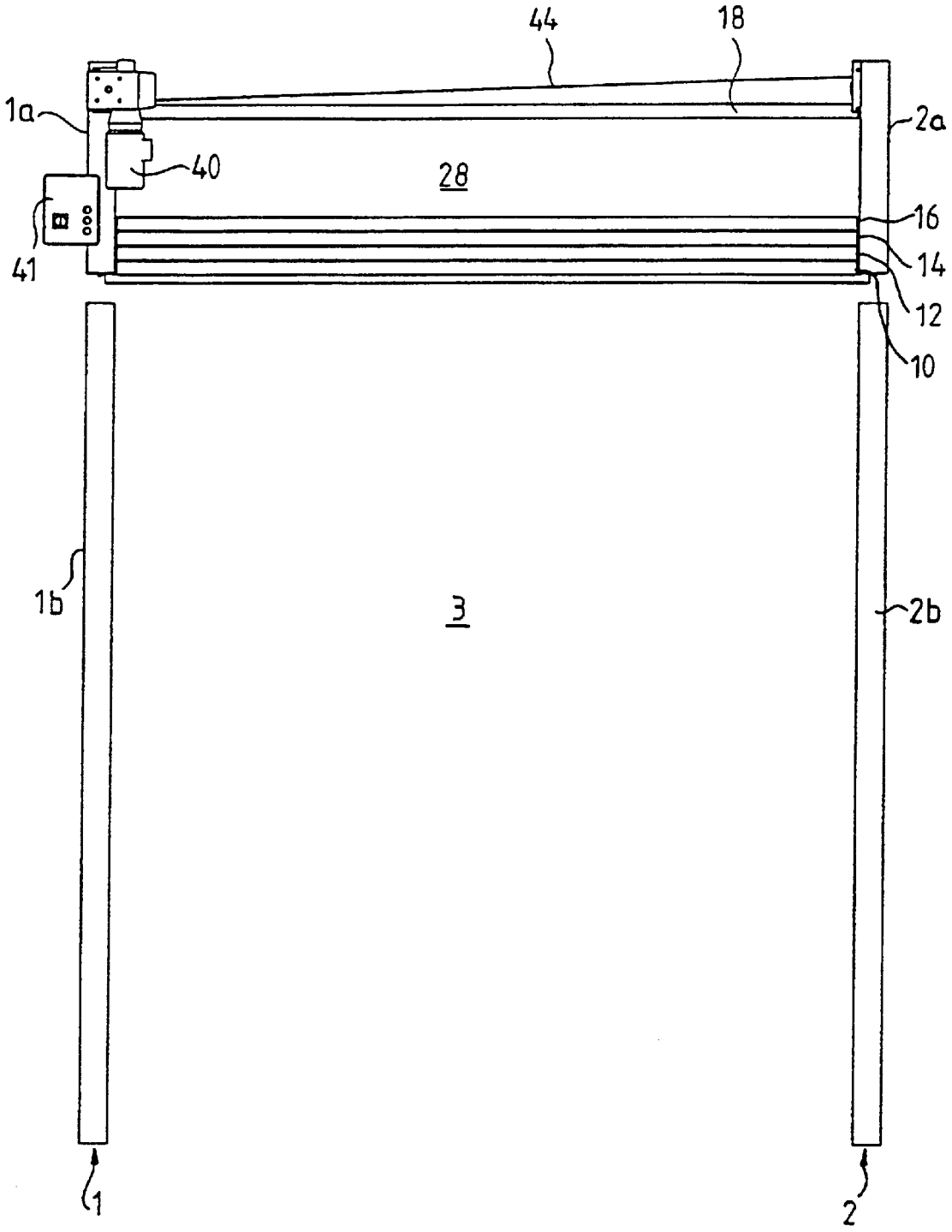
FIG. 12 schematically shows how a door according to FIGS. 1–7 can be assembled.

Particularly easy transportation and assembly of the door according to the invention can be achieved if the side frames 1, 2 are made sectional as shown in FIG. 12. Each side frame 1 and 2 is divided into a shorter top part 1*a* and 2*a*, respectively, and a longer bottom part 1*b* and 2*b*, respectively. When the door is manufactured, the entire upper part in FIG. 12 is made as a separate, single unit, comprising the top parts 1*a*, 2*a*, the door leaf 4 with its reinforcement members 10–18, all lifting belts 43, 44, the drive motor 40, the control unit 41 (which is later moved down), and all the guide members 110–118 received in the two guide channels 68, 69 of the top parts 1*a*, 2*a*. In connection with the installation of the door, the bottom parts 1*b* and 2*b* of the side frames 1, 2 can be assembled first, whereupon the entire unit is lifted into place.

As an alternative to forming all the door leaf sections 21–28 of a single cloth material, the door leaf 4 can be made double, possibly with an intermediate flexible material for e.g. thermal insulation and/or sound-proofing. Furthermore, all or some of the door leaf sections 21–28 can be transparent over their whole surface or part of their surface.

As a variant to a whole, unbroken piece of cloth, it is possible to use separate portions of cloth for each door leaf section 21–28, which, in this case, can advantageously be interconnected by means of the reinforcement members 10–18 in a suitable manner, for example by being inserted into grooves in the same.

As an alternative to the embodiments shown with a vertically movable door leaf 4, it is conceivable instead to place the side frames 1, 2 horizontally and to guide the door leaf 4 in a horizontal direction with the aid of suitable pulling means in both directions.

In the embodiment shown, the reinforcement members 10–18 are on a level with the edge guide members 110–118, but it is conceivable to omit some or all of the reinforcement members 10–18 in other embodiments.

Figure 13:
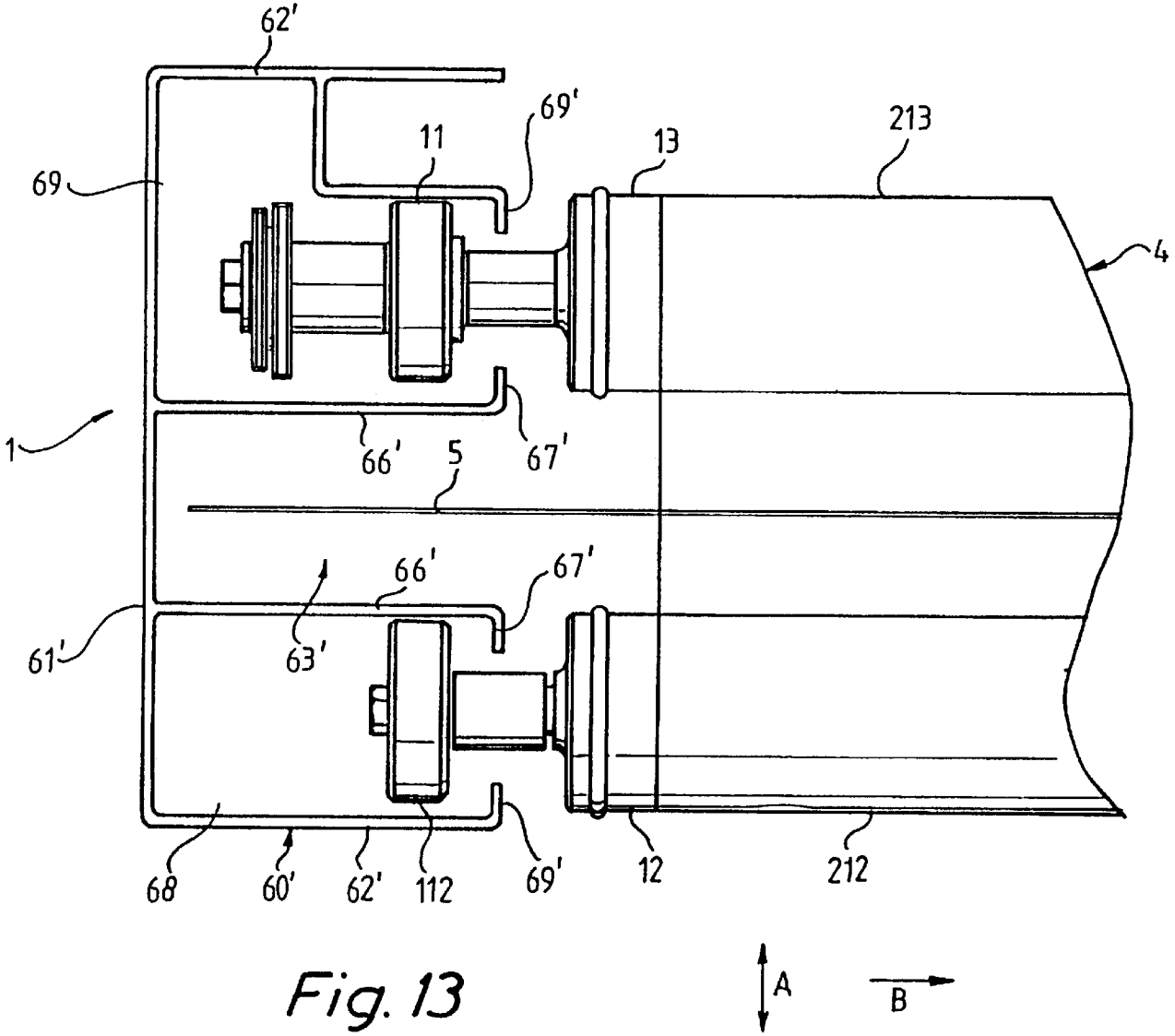
FIG. 13 is a breakaway cross-sectional view corresponding to the view in FIG. 7, but of an alternative embodiment of the guide channels.

In alternative embodiments, the fall-out-preventing means for the guide members 110–118 can be accomplished in other ways than with the inner section 63, although it is preferable in some cases to provide a fall-out-preventing means and edge sealing with one and the same section. FIG. 13 illustrates such an alternative embodiment. In FIG. 13, the one side edge 5 of the door leaf 4 is connected to and guided along the corresponding side frame 1. The arrangement in the other side edge 2 is identical and, therefore, is not described. The side frame 1 is designed to achieve guiding of the folding of the door leaf 4, guiding of its motion in the depth direction (arrow A) and in the transverse direction (arrow B), and sealing of the side edge 5 of the door leaf against the side frame 1. To this end, the side frame 1 is composed of a frame section 60' with a bottom wall 61' and two opposite side walls 62'. The smaller U-shaped inner section 63 and the partition 66 in FIG. 7 have been replaced by two partitions 66', each of which is provided with a fall-out-preventing flange 67'. As illustrated in FIG. 13, the two opposite side walls 62' are also provided with fall-out-preventing flanges 69'. In this embodiment, the door leaf edge 5 extends in a space 63' between the guide members 110–118 essentially all the way up to the bottom wall 61'. The guide members 110–118 are guided in guide channels 68 and 69 defined by the side walls 62' and the partitions 66'. The partitions 66' extend along essentially the entire length of the frame section 60. In this embodiment, the walls 61', 62' and 66' of the frame section 60' are all made in one piece.

The embodiments shown can be supplemented with a stretching device adapted to force the door towards the closed position when it is being lowered, and preventing the door leaf from being lifted by wind load and/or in a break-in. If the door is to be designed for horizontal motion such a stretching device is required for the closing motion.

The embodiments shown can also be supplemented with a counterbalancing device adapted to balance the weight of the door leaf, or, alternatively, an overbalancing device to facilitate opening e.g. in connection with a power failure.

What is claimed is:

1. A door, comprising:

a door leaf (4) which is at least partly made of a flexible cloth material and which is movable between a closed position and an open, folded position, in which open position the door leaf (4) is folded around a plurality of folding lines extended between opposite side edges (5, 6) of the door leaf, a plurality of guide members (110–118) which are connected to said opposite side edges (5, 6) in a spaced-apart relationship along said side edges (5, 6), and two side frames (1, 2) which are extended adjacent to a respective side edge (5, 6) for guiding the guide members (110–118), characterised in that:

each side frame (1, 2) defines at least a first and a second guide groove (68, 69), which are juxtaposed transversely of the side frame, said guide members (110–118) comprise, at each side frame (1, 2), a first set of guide members (110, 112, 114, 116,. 118) running in the first groove (68) only of the side frame (1, 2), and a second set of guide members (111, 113, 115, 117) running in the second groove (69) only of the side frame (1, 2), and the first and the second guide members (110–118) are connected to the door leaf (4) in such a way that the side edges (5, 6), in the folded position of the door leaf, run back and forth between the first and second guide grooves (68, 69) with said folding lines defined by the guide members (110–118);

at least one flexible pulling member (43, 44) for guiding the movement of the door leaf (4);

said at least one flexible pulling member (43, 44) applies a direct lifting force only upon a driven guide member formed by a predetermined guide member (111, 112) of the guide members (110–118);

said driven guide member is a guide member (110–118) which in the closed position is located second closest to the closing edge (8) of the door leaf (4).

2. A door as claimed in claim 1, wherein the first and second guide grooves (68, 69) are juxtaposed transversely of the door opening (3).

3. A door as claimed in claim 1, wherein said at least one flexible pulling member (43, 44) is in each side frame (1, 2).

4. A door as claim in claim 1, comprising in each side frame (1, 2) a further pulling member, which applies a direct lifting force only upon a second driven guide member among said plurality of guide members (110–118), the first-mentioned driven guide member and the second guide member running in a respective guide groove of said two guide grooves (68, 69).

5. A door as claimed in claim 4, comprising drive means for driving the first and second pulling members unequal distances during the movement of the door leaf (4) from a closed position to a fully open position.

6. A door as claimed in claim 1, wherein at least some of said plurality of guide members (110–118) abut against each other in the fully open position of the door.

7. A door as claimed in 3, wherein all of the pulling members (43, 44) for guiding the door leaf (4) run inside the side frames (1, 2).

8. A door as claimed in claim 1, wherein the door leaf (4) is provided with a plurality of transverse reinforcement members (10–18), each of which is extended between an associated pair of guide members (110/110, 111/111, . . . 118/118) among said plurality of guide members (110–118).

9. A door as claimed in claim 8, wherein the guide members (110–118) are mounted on end portions of the transverse reinforcement members (10–18).

10. A door as claimed in claim 8, wherein at least the majority of said reinforcement members (10–18) are located alternatingly on the one side and the other side of the door leaf (4).

11. A door as claimed in claim 1, wherein the first guide groove (68) and the second guide groove (69) in each side frame (1, 2) consist of, respectively, a first physical guide channel (68) for the guide members and a second physical guide channel (69) for the guide members.

12. A door as claimed in claim 11, wherein said first and second guide channels (68, 69) both are open in the direction of the door opening (3) and have a width in the transverse direction (A) of the door opening which is adapted to the dimensions of the guide members (110–118) in said transverse direction (A).

13. A door as claimed in claim 11, wherein each side frame (1, 2) is provided with fall-out-preventing means (63; 67', 69') adapted to retain the guide members (110–118) in the guide channels (68, 69).

14. A door as claimed in claim 13, wherein each side frame (1, 2) comprises a U-section (63), which is extended along the frame (1, 2) and opens towards the door opening and which has a bottom wall (64) that partly covers both the first guide channel (68) and the second guide channel (69) in order thereby to form said fall-out-preventing means, and wherein the side edge (5, 6) of the door leaf (4) at each side frame (1, 2) is received in said U-section (63).

15. A door as claimed in claim 11, wherein each side frame (1, 2) comprises:

a bottom wall (61');

a first outer side wall (62') and a first partition (66') both extending from the bottom wall (61') for defining said first guide channel (68); and a second outer side wall (62') and a second partition (66') both extending from the bottom wall (61') for defining said second guide channel (69), wherein said first and second partitions (66') define therebetween a space (63') which receives the side edge (5, 6) of the door leaf (4).

16. A door as claimed in claim 15, wherein said partitions (66') and said outer side walls (62) are provided with fall-out-preventing flanges (67', 69'), for retaining the guide members (110–118) in the guide channels (68, 69).

17. A door as claimed in claim 1, wherein the door leaf (4) is made entirely of a flexible cloth material.

18. A door as claimed claim 1, wherein the door leaf (4) is partly made of a flexible cloth material and partly made of a more rigid material.

19. A door as claimed in claim 1, wherein, (for easier transportation and installation of the door) each side frame (1, 2) is divided into a shorter top part (1*a,* 2*a*) and a longer bottom part (1*b,* 2*b*), the length of the top parts (1*a,* 2*a*) being such that all guide members (110–118) connected to the side edges (5, 6) of the door leaf (4) can be received in the top parts (1*a,* 2*a*) simultaneously.

20. A method for assembling a door as claimed in claim 17, characterised by connecting all the guide elements (110–118) to the door leaf (4) and arranging them in their respective guide groove (68, 69) in the shorter top parts (1*a,* 2*a*) prior to mounting the shorter top parts (1*a,* 2*a*) of the side frames (1, 2) on the longer bottom parts (1*b,* 2*b*) of the side frames (1, 2), and mounting the top parts (1*a,* 2*a*) with the guide members (110–118) introduced therein on the bottom parts (1*b,* 2*b*) only when the door is being installed in the intended location.

* * * * *